United States Patent [19]

Watkins

[11] Patent Number: 4,548,826

[45] Date of Patent: Oct. 22, 1985

[54] METHOD FOR INCREASING THE VOLUMETRIC YIELD OF MICROWAVE COOKED POPCORN

[75] Inventor: James D. Watkins, Prior Lake, Minn.

[73] Assignee: Golden Valley Foods Inc., Eden Prairie, Minn.

[21] Appl. No.: 581,028

[22] Filed: Feb. 17, 1984

Related U.S. Application Data

[63] Continuation of Ser. No. 166,373, Jul. 7, 1980, Pat. No. 4,450,180.

[51] Int. Cl.[4] ..... B65B 43/00; B65B 43/10; B65B 43/12; B65B 43/30

[52] U.S. Cl. ..... 426/394; 426/395; 426/410; 53/459; 53/469; 53/386; 493/931

[58] Field of Search ..... 426/107, 234, 111, 410, 426/113, 243, 394, 412, 395; 229/DIG. 3, 87 F; 383/38, 40, 120; 53/459, 474, 469, 386; 493/918, 920, 931, 248, 194, 195, 209

[56] References Cited

U.S. PATENT DOCUMENTS

| | | | |
|---|---|---|---|
| 2,628,764 | 2/1953 | Rubinstein et al. | 383/120 |
| 2,673,805 | 3/1954 | Colman | 426/111 |
| 2,673,806 | 3/1954 | Colman | 426/111 |
| 2,741,559 | 4/1956 | Banowitz | 426/120 |
| 2,858,970 | 11/1958 | Barnes et al. | 426/111 |
| 2,865,768 | 12/1958 | Barnes et al. | 426/111 |
| 3,035,754 | 5/1962 | Meister | 383/120 |
| 3,052,554 | 9/1962 | Colman | 426/111 |
| 3,107,989 | 10/1963 | Fesco | 383/120 |
| 3,638,784 | 2/1972 | Bodalay et al. | 383/38 |
| 3,835,280 | 9/1974 | Gades et al. | 426/234 |
| 3,844,409 | 10/1974 | Bodalay et al. | 383/38 |
| 3,851,574 | 12/1974 | Katz | 426/111 |
| 3,973,045 | 8/1976 | Brandberg et al. | 426/111 |
| 4,036,423 | 7/1977 | Gordon | 229/43 |
| 4,038,425 | 7/1977 | Brandberg et al. | 426/111 |
| 4,292,332 | 9/1981 | McHam | 426/111 |

FOREIGN PATENT DOCUMENTS

| | | | |
|---|---|---|---|
| 55656 | 1/1939 | Denmark | 229/DIG. 3 |

OTHER PUBLICATIONS

Modern Packaging, 3/54, p. 140+.

*Primary Examiner*—Steven Weinstein
*Attorney, Agent, or Firm*—James V. Harmon

[57] ABSTRACT

A method is described of filling and sealing a popcorn package. A flexible bag is provided which may be formed from flexible sheet material such as paper having longitudinally extending gussets in which the infolded portions of the gussets approach each other closely to divide the bag into a pair of collateral tubes communicating together along a central line. The bag is held in an upright position with one of the tubes in a collapsed state while the other is expanded. The expanded tube has a smaller cross-section than the other tube. A charge of fat and corn is introduced into the tube of smaller cross-section through its open top. Preferably, a means is provided for collapsing the tube of smaller cross-section transversely at a point below the center of the bag but above the bottom end of the bag to maintain the charge at the center of the bag and in the smaller tube. The bag is then sealed. During popping in a microwave oven, microwave energy is absorbed efficiently to achieve a popped volume about 10% to 15% greater than an equivalent package with tubes of equal cross-section. The popcorn passes during heating from the smaller tube to the larger tube as the bag expands during the popping operation.

14 Claims, 17 Drawing Figures

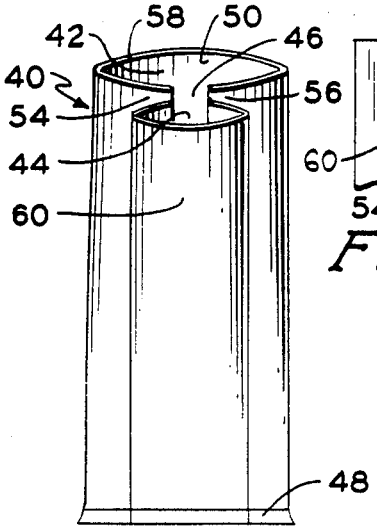
FIG. 3
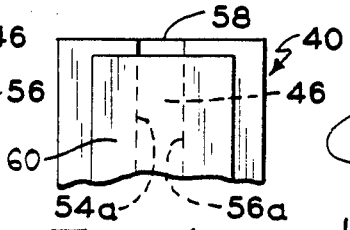
FIG. 4
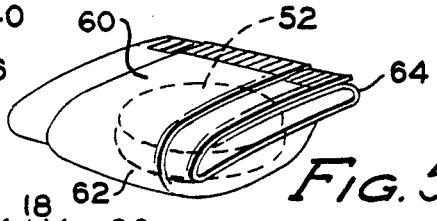
FIG. 5
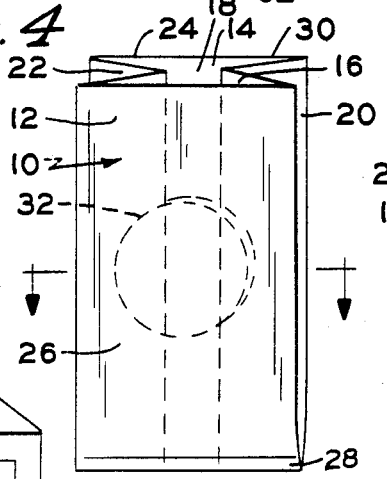
FIG. 1
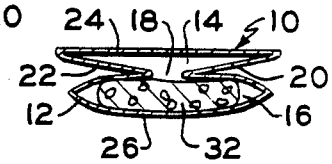
FIG. 2
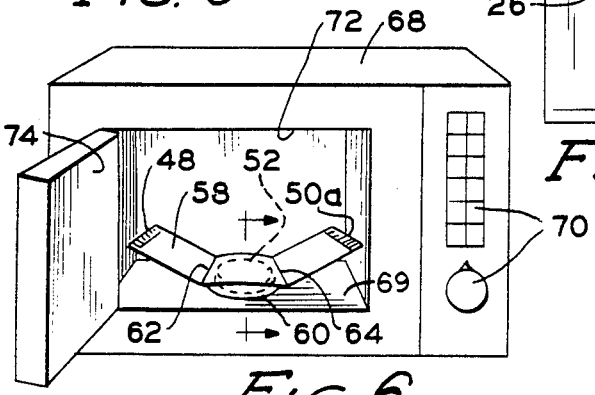
FIG. 6
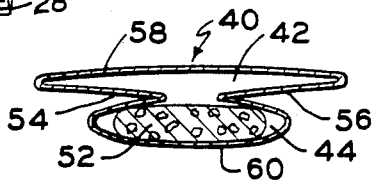
FIG. 7
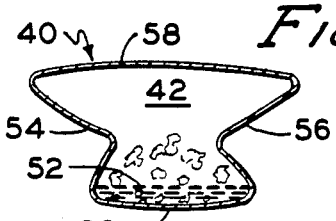
FIG. 8
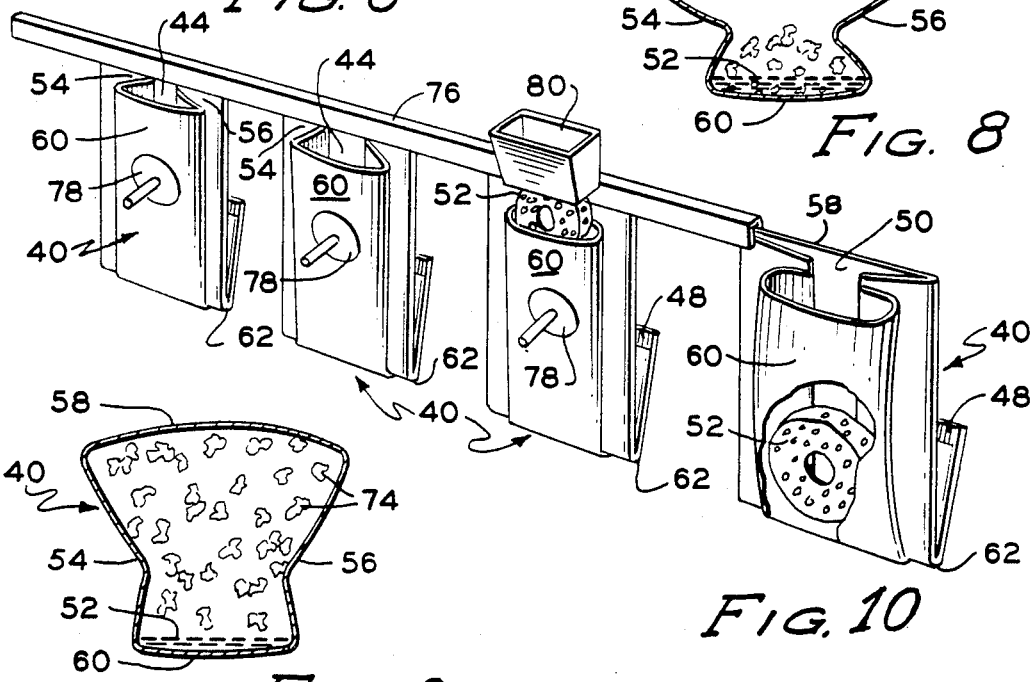
FIG. 10
FIG. 9

METHOD FOR INCREASING THE VOLUMETRIC YIELD OF MICROWAVE COOKED POPCORN

The present application is a continuation of application Ser. No. 166,373 filed 7/7/80 for PACKAGE AND METHOD FOR INCREASING THE VOLUMETRIC YIELD OF MICROWAVE COOKED POPCORN by James D. Watkins now U.S. Pat. No. 4,450,180.

FIELD OF INVENTION

The invention relates to the cooking of packaged foods and to a method for popping popcorn with microwave energy.

THE PRIOR ART

In recent years several manufacturers have begun distributing popcorn in gusseted paper bags. The corn is popped by placing the entire bag in a microwave oven. The corn is heated with microwave energy while it remains in the bag. As the corn pops, the bag expands to accommodate the popped kernels.

One of the shortcomings of commercial products has been the problem of maintaining the best possible volumetric yields. The yield is measured by popping a standard quantity of corn in its package within a microwave oven, pouring the popped kernels into a graduate and measuring the total volume. These volumes have not always been satisfactory and all too often a disappointingly high number of kernels remain unpopped. Moreover, those that do pop are often of less than maximum volume. In work leading to the present invention it was discovered that the food product in the popping container can itself interfere with bag expansion. U.S. Pat. Nos. 3,973,045 and 3,835,280 are representative of the prior art. As shown, for example, in U.S. Pat. No. 3,973,045, FIGS. 2 and 3, the charge is distributed throughout the full cross section of the bag. The same homogeneous distribution is shown in U.S. Pat. No. 3,835,280, FIGS. 3 and 4. These packages do not, when heated, achieve maximum potential volumetric yields.

OBJECTS OF THE INVENTION

The major objective is to provide a package and method for improving the volumetric yield of popcorn distributed and popped in containers of the type described.

Another object is to provide the above improvements without substantially increasing costs.

A further object is to find an effective way to reliably position a charge of corn and fat within a package so as to increase volumetric yields.

Another object is to provide a method of increasing volumetric yields of popped corn by positioning the charge of unpopped corn within the bag and oven in a new way.

A further object is to provide a bag of special configuration that will improve volumetric yields and promote bag expansion when used as a container for popping popcorn within a microwave oven.

Yet another object is to provide an improved package of unique configuration containing a charge of unpopped popcorn and fat placed in a predetermined position within the package which cooperates with the package configuration to improve volumetric yields of microwave popped corn.

THE FIGURES

FIG. 1 is a perspective view of the package in accordance with the invention filled with a charge of popcorn and fat.

FIG. 2 is a transverse cross-sectional view taken on line 2—2 of FIG. 1.

FIG. 3 is a perspective view of the package in accordance with another form of the invention prior to filling.

FIG. 4 is a partial side elevational view of the bag shown in FIG. 3 as it appears in a flattened condition prior to filling.

FIG. 5 is a perspective view of the package of FIGS. 3 and 4 after being filled and folded for shipment.

FIG. 6 is a perspective view of the package of FIG. 5 after being unfolded and properly oriented in a microwave oven preparatory to cooking.

FIG. 7 is a transverse cross-sectional view taken on line 7—7 of FIG. 6.

FIG. 8 is a view similar to FIG. 7 as it appears when the popcorn begins to pop.

FIG. 9 is a view similar to FIG. 8 in a later stage in the popping cycle.

FIG. 10 is a diagramatic perspective view of one method of filling the bags in accordance with the invention.

SUMMARY OF THE INVENTION

Figure 11:
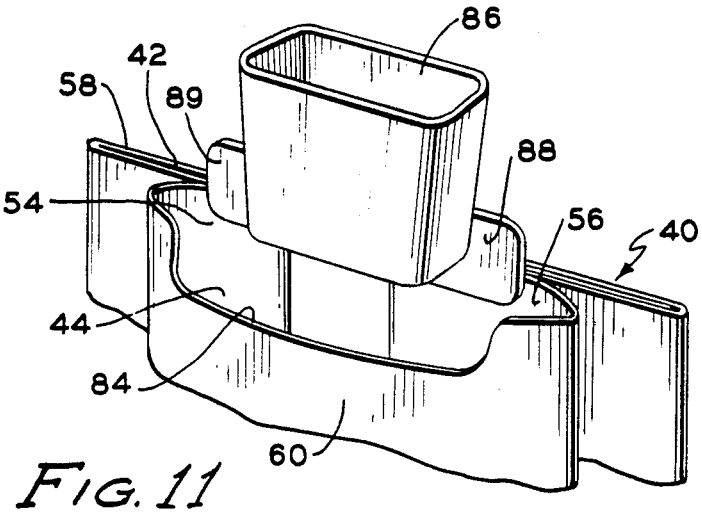
FIG. 11 is a partial perspective view of the top of a modified form of bag in accordance with the invention showing another means of filling the bag.

Briefly the invention provides a method for manufacturing a popcorn shipping package to be used for popping corn within a dual purpose shipping and popping container, e.g., a bag, with increased volumetric yields of popped corn. One aspect of the invention is the provision of a package formed from flexible sheet material of collateral tubular configuration, that is to say, comprising two parallel longitudinally extending sections communicating together at the center of the package. Substantially all of the charge of popcorn and fat is placed within one tubular section and the other is maintained free of popcorn. The package filled in this manner is positioned with the charge lowermost in the microwave oven. During popping the upper tubular section is free to expand as it fills with popcorn while the lower tubular section continues to hold unpopped corn and liquefied fat. Another aspect of the invention is the provision of a package as just described wherein one of the tubular bag sections is of a smaller cross-sectional size than the other. The charge of corn and fat is placed in the tubular section of the smallest diameter. In one practical embodiment of the invention the package comprises a gusseted bag including a pair of face panels and interconnecting centrally projecting side gussets thereby defining the two tubular sections. The first face panel is of greater width than the second face panel. Typically the area of the smaller face panel is about 18% to 50% less than the area of the larger face panel.

The invention also discloses automated methods for filling packages in accordance with the invention in such a way as to properly locate the charge.

DETAILED DESCRIPTION

Refer to FIGS. 1 and 2. These figures illustrate a form of the invention in which a package is employed having face panels of equal size. The embodiment of FIGS. 1 and 2 comprises a package 10 composed of a bag 12 formed from flexible sheet material such as paper and being of collateral tubular configuration, that is to say, being composed of a pair parallel longitudinally extending tubes 14 and 16 which communicate with one another along a central longitudinal opening 18. The two parallel tubes 14 and 16 are separated by longitudinally extending side indentions 20 and 22. When the package comprises a paper bag, the bag can be composed of first and second face panels 24 and 26 respectively of equal size, and the indentions 20 and 22 comprises gussets. The bag shown in FIG. 1 has bottom seal 28. After being filled, the top 30 is also sealed conventionally by means of heat or a suitable adhesive.

As best seen in FIG. 2 a food product 32 comprising a mixture of popcorn and fat is placed in the collateral tube 16 while the tube 14 is maintained substantially free from the charge of popcorn and fat. By maintaining the charge substantially entirely in one of the collateral tubes, a surprising increase in the volume of the popped corn will result. For example, in one test a volumetric increase of almost 10% was achieved. The placement of the charge can be thought of as being lateral, i.e. closer to one face panel of the bag as opposed to the prior art in which the popcorn charge is distributed homogeneously across the bag and usually is divided almost equally between both tubes such that approximately half of the charge being in tube 14 and half being in tube 16.

When the package is heated to pop the corn, tube 16 containing the charge 32 is preferably placed downwardly in the microwave oven. In this position panel 26 contacting the charge 32 faces downwardly and contacts the bottom wall of the cooking chamber of the microwave oven as will be described in more detail below in connection with FIG. 6. It will also be noted that the charge 32 is located approximately centrally with respect to the ends of the bag that is to say, approximately halfway between the top 30 and the bottom seal 28.

Refer now to Table I which illustrates the improvement in volume of popped corn that can be achieved through the invention embodied in FIGS. 1 and 2. As can be seen, a volumetric increase in the popped corn of 9.4% was accomplished using the lateral placement of the charge as shown in FIGS. 1 and 2 compared with the homogenous or random placement of the charge throughout the entire cross-section of the bag. It is believed that even better results can be obtained than those shown in the table with optimum bag dimensions, corn varieties and popping conditions etc.

TABLE I

| Popped Volume of Corn with Homogenous Placement vs. Lateral Placement of Charge* | |
|---|---|
| Homogenous Placement (prior art) | 1600 ± 420 cc |
| Lateral Placement (Invention) | 1750 ± 290 cc volume increase 9.4% |

*700 watt microwave oven, cooking time 4 minutes, charge 3.5 oz. at 0° F.

Refer now to FIGS. 3 through 9 which illustrate another form of the invention. As shown best in FIGS. 3 and 4, a package 40 is provided comprising a bag formed from flexible sheet materials such as paper preferably with a greaseproof paper liner of suitable known construction and including first and second parallel collateral tubes 42 and 44 both of which extend longitudinally and communicate with one another along midline at 46. The bag is sealed by means of a bottom seal 48 and prior to filling is open at the top 50 such that a charge of popcorn and fat 52 can be introduced as shown in FIG. 5. After the charge has been introduced, the top 50 is sealed as shown at **50*a* in FIG. 6. It can be seen in FIGS. 3 and 4 that the collateral tubes 42 and 44 are separated by indentions 54 and 56 and although not essential to the invention, the indentions can be conveniently formed by constructing the bag with longitudinally extending centrally projecting gussets at 54 and 56. The bag after being constructed will usually be flattened to the condition shown in FIG. 4 with the innermost aspect of the gussets 54 and 56 comprising folds indicated by dotted lines 54*a* and 56*a*. Accordingly the bag is provided with two longitudinally extending face panels; panel 58 and panel 60 which is smaller in width and area than face panel 58. While size is not critical it is preferred that the panel 60 be about 18% to 50% smaller in area than the panel 58. Consequently tube 44 is smaller in cross sections than tube 42. The term "cross-section" herein has reference to the tubes when fully expanded to circular configuration as shown in FIG. 3. The bag illustrated is a tube type bag, that is, a bag formed from a continuous tube of paper manufactured on a so called bag tuber and cut transversely at uniform intervals to define the top and bottom ends 50 and 48. The bag can however, be of the pasted bottom type with folding panels at the top and bottom of the bag which are pasted shut after the bag is filled. It should be noted that the charge 52 is placed approximately intermediate to the ends of the bag as shown in FIGS. 5 and 6. After filling and sealing the top 50 at 50*a*, the bag is folded transversely at 62 and 64 to divide the bag roughly into three equal sections for convenient shipment with the charge 52 in approximately the center of the bag as best seen in FIG. 6**.

The charge 52 is placed in the tube 60 of smaller cross section, that is to say, laterally of the midline of the bag. The larger tube 42 is maintained substantially free of the charge of popped corn fat.

Figure 17:
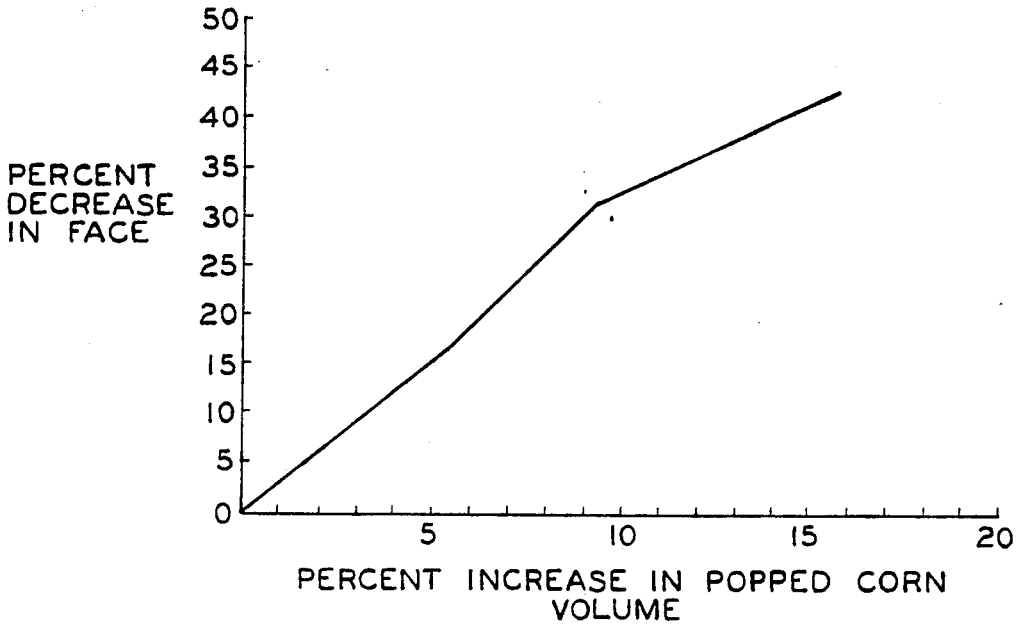
FIG. 17 is a graph relating the face areas to popped volume.

When the corn is to be popped, the package 40 is positioned horizontally and placed in a microwave oven 68 with the panel 60 facing downward. The charge 52 is thus located adjacent the floor 69 of the cooking chamber 72 within oven 68. The microwave oven 68 which is itself entirely conventional, includes the usual oven controls 70, cooking chamber 72 and door 74. After the door 74 is closed, microwave energy will heat the charge 52 causing the fat to melt as shown in FIG. 8 and some of the popcorn will pop while steam is generated filling the first relatively large tubular section 42 with a combination of steam and popped corn. As cooking continues, more and more of the charge 52 will pop and the package will become filled with popped kernels 74. The invention results in a substantial increase in volumetric yields as shown in Table 2 and FIG. 17. A reduction of the bottom panel 60 to 29.25 square inches produces a 6% increase in popped volume, a reduction to 24.75 square inches produces a 10% increase and a reduction to 20.75 square inches produces a 16% increase in the popped volume of the corn. This is illustrated graphically in FIG. 17.

TABLE 2

Popped Volume of Corn vs. Area of Bottom Face of Container

| Area of Faces (sq. in.) Top | Bottom | Popped Volume of Corn (c.c) | Percent Reduction of Bottom Face Panel area | Percent Increase in Popped Vo. |
|---|---|---|---|---|
| 35.75 | 35.75 | 1805 ± 250 | (None, both panels equal) | |
| 35.75 | 29.25 | 1920 ± 220 | 18% | 6% |
| 35.75 | 24.75 | 1990 ± 190 | 31% | 10% |
| 35.75 | 20.75 | 2100 ± 200 | 43% | 16% |
| 35.75 | 24.00 | 1980 ± 210 | 33% | 9% |

Refer now to FIG. 10 wherein the same numerals refer to corresponding parts illustrated in FIGS. 3 through 9. As can be seen, the bags 60 have been folded transversely along line 62 and are located in an upright position during filling they are transferred laterally from left to right in the figure using any of several well known filling machines that are commercially available. Thus the package 40 is carried from left to right by means of a conveyor that is part of transfer and filling machine (not shown). In this form of the invention the upper end of tube 44 is shorter than tube 42. This is accomplished by cutting off the top portion of tube 44 beginning at the marginal edges 54*a* and 56*a* of the gussets 54 and 56. The upper edge of tube 42 slides within a downwardly opening U-shaped guiderail 76. This allows the tube 44 to be opened at the proper time by means of a suction cup 78 which engages panel 60 and draws the panel away from panel 58. A filling spout 80 is placed in proximity with each successive bag such that its bottom end is aligned with the upper open end of the small tube 44. As the bag passes beneath filling spout 80, a charge of popcorn and fat 52 is inserted and as can be seen, falls entirely within tube 44 so that the larger collateral tube 42 is maintained substantially free of the charge of fat and popcorn. The transverse fold 62 maintains the charge 52 in approximately the center of the bag, that is to say, intermediate the ends 48 and 50. This function can be accomplished in other ways, e.g. with a clamp, placed on the bag. After filling, the top 50 the bag is sealed in any conventional well known manner as by means of adhesive or heat sealing.

Figure 12:
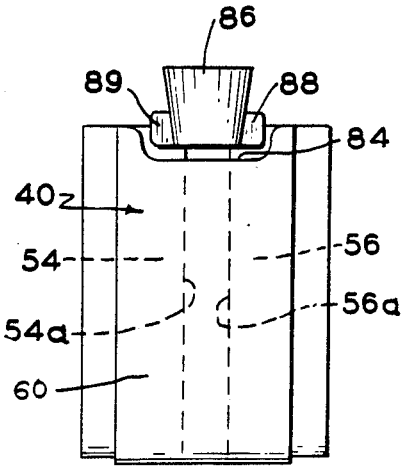
FIG. 12 is a vertical side elevational view of the filling operation illustrated in FIG. 11.

Refer now to FIGS. 11 and 12 which the same numbers refer to corresponding parts in the previous views. The package 40 is the same as previously described except that instead of the entire upper end of tube 44 being shorter than tube 42, a cutout section 84 is provided entirely within the panel 60. The cutout 84 may extend downwardly toward the bottom of the bag about ½ to 1 inch to accommodate a filling spout 86 having tabs or lateral extensions 88 and 89 which engage the uppermost edges of the gussets 56 and 54 respectively as best seen in FIG. 11. The spout and its extensions 88 and 89 hold the gussets on top of the bag against the upper edge of the larger tube 44 which is in turn pressed against a vertical plate or other surface which for simplicity has not been shown in the figures. After the spout 86 and the extensions engage the gussets, 54 and 56, the panel 60 is pulled outwardly e.g. by a suction cup (not shown) to open tube 44. Once tube 44 is opened, the charge of corn and fat is dropped in the spout 86, and is allowed to fall into tube 44 thereby locating it in the desired position entirely within tube 44. The tube 42 which is maintained in a flattened condition at this point will be substantially free of the food product.

Figure 13:
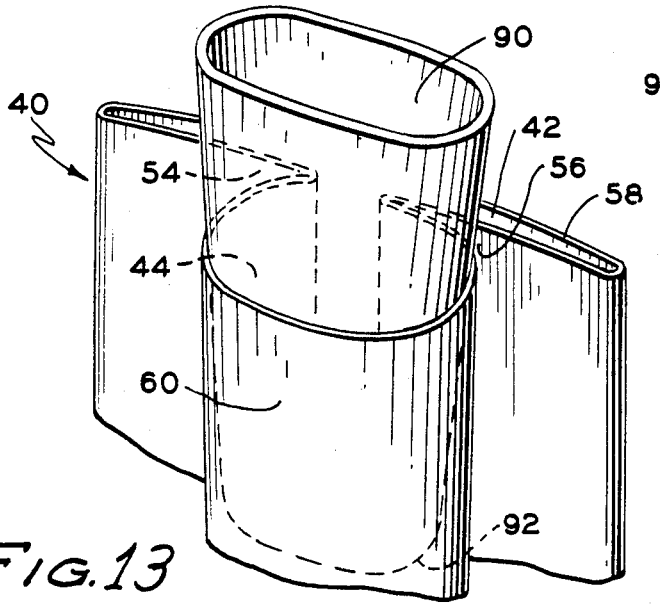
FIG. 13 is a perspective view of another method of filling the bags in accordance with the invention.

FIG. 13 illustrates a similar filling method where the same numerals refer to corresponding parts. In this case a filling spout 90 is used. Spout 90 is not provided with tabs and is somewhat longer from top to bottom than spout 86. In this filling method, the lower open end 92 of the spout 90 is inserted into tube 44 which is then drawn upwardly over the spout. As can be seen, this will open the tube 44 allowing the charge of corn and fat to be introduced while the collateral tube 42 remains flattened and free from any substantial quantity of the food product. It is to be understood that in all of the embodiments of the invention, incidental quantities of the food product may spill over into the unfilled tube and that such spillover which sometimes happens in high speed commercial production lines will not depart from the spirit or scope of the present invention.

Figure 14:
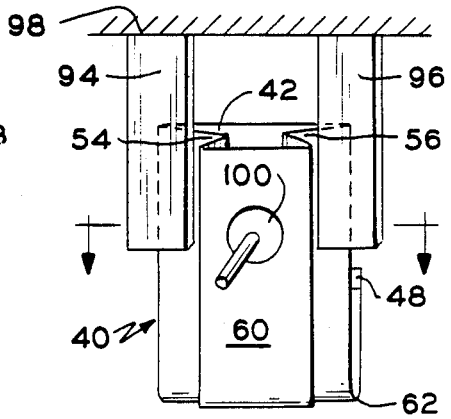
FIG. 14 is a perspective view of another filling method.
Figure 15:
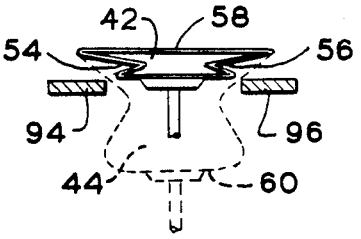
FIG. 15 is a horizontal cross-sectional view taken on line 15—15 of FIG. 14.

In FIGS. 14 and 15 a similar filling method is shown except that no spout is employed. In this case a pair of parallel downwardly depending fixed retaining arms 94 and 96 supported from a stationary framework 98 hold the side edges of the flattened tube 42. A suction cup 100 engages panel 60 and draws it away from panel 58 thereby expanding the smaller collateral tube 44. The charge is then dropped into tube 44.

Figure 16:
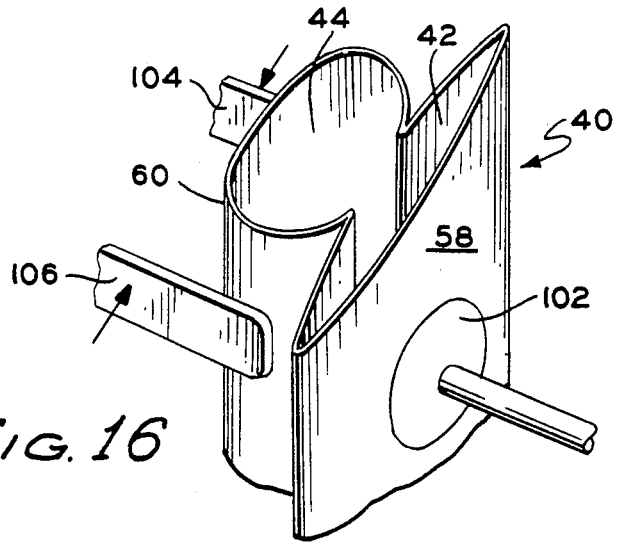
FIG. 16 is a perspective view illustrating still another method of filling bags in accordance with the invention.

FIG. 16 shows a somewhat similar arrangement except that in this case panel 58 is engaged by a stationary suction cup 102 and a pair of pincher arms 104 and 106 which engage the side edges of panel 60 are brought centrally towards one another in the direction shown by the arrows thereby pinching the tube 44 to expand it for filling. Once tube 44 has been expanded as shown in the FIGURE, the charge is introduced.

The charge 52 can be introduced in many forms. For example the corn and fat can be introduced separately or together and the fat may be either solid or heated till fluid. However, if solid, less transfer to the other tube will take place. One preferred form of the charge is shown in FIG. 10. The charge is composed of fat and corn generally in the shape of a doughnut i.e. annular. It was found that the heat transfers to the food faster when it is in this shape.

Bags may be manufactured by any known method but are preferably formed on a bag tuber. The folding shoes of the tuber should be arranged for all embodiments other than FIGS. 1 and 2 such that the gusset folds are formed in the proper location to make one face of the bag smaller than the other. The tube forming apparatus is otherwise standard. A typical bag when folded flat as shown in FIGS. 1 through 9 may have a height of 12" and a width of 5½". Where panel 60 is reduced in width it may be from about 4 to 4½ wide. It was found that for each 10% decrease in the area of one face the popped volume will increase by about 3% (See FIG. 17).

The charge 52 of popcorn and fat can have any known commercially acceptable formula preferably about 10 parts corn for each 4 parts of fat. One satisfactory formula used with the present invention is 68.5% corn, 27.6% fat and 2.8% salt by weight. The fat comprises hydrogenated coconut oil having a melting point between about 80° F. to 130° F. Packages are shipped frozen and maintained under refrigerated conditions prior to use. Accordingly it can be seen that the fat is normally in solid form when below about 80° F. The charge placed in the bag will therefore remain in the position where it is placed at the time of filling.

While the reason for the success of the invention in improving volumetric yields is not known with certainty, it is believed that the lateral placement of the charge described and the location of it adjacent to the bottom of the wall of the oven permits the bag to expand more easily as soon as gas and vapor is generated responsive to heating and even before the fat is all melted. It is also believed that the invention as described in Figures other than 1 and 2 performs better than the prior art because the reduced panel size concentrates the charge and causes more of the corn to remain immersed in the hot fat during the cooking operation thereby promoting better heat transfer to the unpopped kernels. The narrower the smaller face panel is made the greater will be the volume of popped corn. Of course, the face dimensions cannot be reduced to such an extent that the package is not capable of holding the volume of corn to be contained in the package. Therefore reduction in the smaller panel area of less than 50% of the area of the large panel is not usually practical.

Many variations of the invention within the scope of the appended claims will be apparent to those skilled in the art.

What is claimed is:

1. A method of filling and sealing a popcorn bag comprising, providing a bag for storing and shipping popcorn, the bag being formed from flexible sheet material transparent to microwave energy and having a top and bottom and a relatively large face panel on one side, a narrower face panel on the other side and sections of interconnecting folded gusset material projecting centrally between the side edges of the first and second panels with the centrally projecting gussets approaching each other closely enough to divide the bag into a pair of collateral tubes, one of which is relatively large in cross-section, and the other relatively small in cross-section, placing a charge of fat and corn substantially entirely within the tube of smaller cross-section, and maintaining the other tube substantially free of fat and corn and sealing the top and bottom of the bag to seal the tubes and maintaining the charge of popcorn and fat in the tube of smaller cross section and centrally thereof, said tubes being in communication with each other between the gussets whereby when the bag containing the popcorn is heated within a microwave oven by the application of microwave energy, the popcorn will pass from the smaller tube to the larger tube during popping within the bag as the bag expands to achieve a popped volume increase on the order of 10% to 15% or more compared to an equivalent package with tubes of equal cross-section.

2. The method of claim 1 wherein prior to filling one of said tubes is maintained in a collapsed condition while the other said tube is expanded to an open condition and the charge is thereafter introduced into the open tube.

3. A method of filling and sealing a popcorn bag comprising, providing a bag for storing and shipping popcorn, the bag being formed from flexible sheet material transparent to microwave energy and having a top and bottom and a relatively large face panel on one side, a narrower face panel on the other side and sections of interconnecting folded gusset material projecting centrally between the side edges of the first and second panels with the centrally projecting gussets approaching each other closely enough to divide the bag into a pair of collateral tubes, one of which is relatively large in cross-section and the other relatively small in cross-section, holding the bag in an upright position, opening the smaller tube at least at the top, inserting a charge of corn and fat into the smaller tube while in an open condition and maintaining the other tube substantially free of fat and corn and sealing the top and bottom of the bag to seal the tubes and maintaining the charge of popcorn and fat in the tube of smaller cross-section and centrally thereof, said tubes being in communication with each other between the gussets whereby when the bag containing the popcorn is heated within a microwave oven by the application of microwave energy, the popcorn will pass from the smaller tube to the larger tube during popping within the bag as the bag expands to achieve a popped volume increase on the order of 10% to 15% or more compared to an equivalent package with tubes of equal cross-section.

4. The method of claim 3 wherein the smaller tube is cut shorter at one end than the larger tube, the bags are advanced continuously in an upright position and a means is provided to retain the large tube in a collapsed condition, the smaller tube is held open at ats upper end and the food product is introduced into the open end of the small tube.

5. A method of filling and sealing a popcorn bag comprising, providing a bag for storing and shipping popcorn, the bag being formed from flexible sheet material transparent to microwave energy and having a top and bottom and a first relatively large face panel on one side, a second narrower face panel on the other side and sections of interconnecting folded gusset material projecting centrally between the side edges of the first and second panels with the centrally projecting gussets approaching each other closely enough to divide the bag into a pair of collateral tubes, one of which is relatively large in cross-section and the other relatively small in cross-section, during the filling operation maintaining the tube of relatively large cross section in a collapsed condition and the other tube in an expanded condition, holding the smaller tube in a collapsed condition transversely at a point below the center of the bag but spaced upwardly from the bottom thereof, holding the bag in an upright position and inserting a charge of corn and fat into the smaller tube while the small tube is in an open condition with a portion thereof collapsed to thereby temporarily maintain the charge at the center of the bag during the filling operation and in only one tube, sealing the top and bottom of the bag to seal the tubes and maintaining the charge of popcorn and fat in the tube of smaller cross-section and centrally thereof, the charge of popcorn and fat is thereby confined substantially entirely in the tube of smaller cross-section, said tubes being in communication with each other between the gussets whereby when the bag containing the popcorn is heated within a microwave oven by the application of microwave energy, the popcorn will pass from the smaller tube to the larger tube during popping within the bag as the bag expands to achieve a popped volume increase on the order of 10% to 15% or more compared to an equivalent package with tubes of equal cross-section.

6. A method of filling and sealing a popcorn bag comprising, providing a bag for storing and shipping popcorn, said bag being formed from flexible sheet material transparent to microwave energy and having first and second rectangular face panels each having parallel transversely extending top and bottom edges and parallel vertically extending side edges, sections of interconnecting folded gusset material projecting centrally between the side edges of the face panels with the centrally projecting gussets approaching each other closely enough to divide the bag into first and second collateral tubes, holding the bag in an upright position with the top edges of the panels uppermost, expanding the first tube to open said tube by drawing the first face panel away from the second collateral tube, maintaining the second collateral tube in a collapsed condition by keeping said second panel in contact with adjacent sections of gusset material inserting a charge of popcorn and fat into the expanded tube by allowing the charge to fall into the tube from its open end by gravity, the close proximity of the second panel of the bag and the gussets preventing transfer of the corn and fat during the filling operation into the collapsed tube, sealing the bag and maintaining the bag in a collapsed condition during shipment and storage to prevent expansion and outward folding of the gussets to thereby hold the charge of fat and corn substantially entirely within said first tube until the corn is popped, the tubes being in communication with each other between the gussets whereby when the bag containing the popcorn is heated within a microwave oven by the application of microwave energy the popcorn will transfer from the first tube to the second tube during popping within the bag as the bag expands and the gussets move apart.

7. The method of claim 6 wherein the charge placed in said package comprises about 10 parts of corn for each 4 parts of fat and the package is sealed after the charge is inserted into the bag.

8. The method of claim 6 wherein the charge is dropped into the open tube and means is provided for preventing the charge from falling past a point located approximately intermediate top and bottom ends of the package.

9. The method of claim 6 wherein a filling spout which inserts said charge is provided and the filling spout is slid longitudinally of the bag into the open end of said first tube.

10. The method of claim 6 where a suction cup is secured to said first tube and is moved in the direction proceeding away from the other tube to thereby open said first tube prior to filling.

11. The method of claim 6 wherein a bottom portion of said first tube is maintained in the collapsed position to thereby temporarily maintain the charge at the center of the bag during the filling operation and in only the first tube, the charge of fat and corn thereby falling through the open end of the first tube by gravity until striking the collapsed portion of the first tube whereby the charge is maintained intermediate the ends of the bag.

12. The method of claim 6 wherein a holding means is placed against said second tube, a suction cup means is engaged with the first panel and said suction cup is then moved away from the second tube to expand the first tube while the second tube is kept in a collapsed condition by the holding means.

13. The method of claim 6 wherein a filling spout which inserts said charge is placed in proximity to the bag with its bottom end aligned with the upper free open end of said first tube.

14. The method of according to claim 13 wherein tabs are provided on the filling spout and the tabs are engaged against the top edge of the gussets to hold them against the upper edge of said second tube.

* * * * *